US005451844A

United States Patent [19]

Walkos et al.

[11] Patent Number: 5,451,844

[45] Date of Patent: Sep. 19, 1995

[54] METHOD AND APPARATUS FOR CAUSING ELECTRIC LAMP TO FLASH

[75] Inventors: Gerald D. Walkos, Stafford, Va.; Dana R. Harn, Morgantown, W. Va.; William I. Walkos, LaPlata, Md.

[73] Assignee: Response Technology Corporation, Vienna, Va.

[21] Appl. No.: 299,418

[22] Filed: Sep. 1, 1994

[51] Int. Cl.[6] ..... H05B 37/00

[52] U.S. Cl. ..... 315/200 A; 315/217; 315/225; 315/125; 315/362; 315/77

[58] Field of Search ..... 315/200 A, 217, 225, 315/125, 241 S, 77, 362; 340/81, 331

[56] References Cited

U.S. PATENT DOCUMENTS

| | | | |
|---|---|---|---|
| 360,124 | 3/1987 | Thomson | 315/362 |
| 3,058,032 | 10/1962 | Woodward | 315/72 |
| 3,170,050 | 2/1965 | Buturuga | 200/42 |
| 3,728,713 | 4/1973 | Alten | 315/200 A X |
| 3,940,657 | 4/1976 | Kasiewicz et al. | 315/200 A X |
| 4,038,582 | 7/1977 | Horwinski | 315/129 |
| 4,114,071 | 9/1978 | Thrower, Jr. et al. | 315/226 |
| 4,556,863 | 12/1985 | Devitt et al. | 315/200 A X |
| 4,739,187 | 4/1988 | Nelson et al. | 307/115 |
| 4,952,906 | 8/1990 | Buyak et al. | 315/241 S X |
| 4,983,960 | 1/1991 | Dunn | 340/331 X |
| 5,070,327 | 12/1991 | Ellingson | 340/331 X |

*Primary Examiner*—Robert J. Pascal
*Assistant Examiner*—Haissa Philogene
*Attorney, Agent, or Firm*—Dickinson, Wright, Moon, Van Dusen & Freeman

[57] ABSTRACT

A circuit that includes a latch and an oscillator is attached to a common lamp control switch to cause the lamp to flash when the switch is manipulated in accordance with a prescribed pattern. The flashing draws attention to the lamp and is used, for example, in an emergency. In a first embodiment, the circuit is placed in parallel with the switch. In a second embodiment, the circuit is placed in series with the switch. In both embodiments, the circuit is small enough to fit within an existing switch box.

14 Claims, 3 Drawing Sheets

METHOD AND APPARATUS FOR CAUSING ELECTRIC LAMP TO FLASH

TECHNICAL FIELD

This invention relates to the art of electronic circuits for the control of electric lamps. In particular, the invention is a circuit for causing a lamp to flash, for example, to indicate an emergency situation.

BACKGROUND OF THE INVENTION

It is often desirable to draw attention to a particular location. For example, it is known to attach a "strobe" light to a residence as part of a security system for alerting emergency personnel to that particular residence in the event of an emergency. These lights are typically wired into the house separate from other lights in the house. Thus, these emergency lights must generally be installed by a specialist, making them expensive to install.

SUMMARY OF THE INVENTION

In accordance with the invention, a device is provided that is easily installed in existing switch boxes of the type that contain a light switch for controlling a light such as a porch light. In a first embodiment, the device includes an electronic circuit that is connected in parallel with the existing switch and fits behind the switch within the switch box. The circuit allows the light switch to control the light in the normal fashion and causes the light controlled by the switch to flash when the switch is manipulated in a prescribed manner.

In a first embodiment, the circuit is placed in parallel with the existing lamp switch. When the existing switch is placed in the "on" position, current is provided to the light, and the area surrounding the light is illuminated. When the switch is placed in the "off" position, current is not provided to the light, and the area is not illuminated. On the other hand, when the switch is turned to the "on" position for a short period of time, in the preferred embodiment less than one and one-half seconds, and then placed in the "off" position, the light will be caused to flash, thus, drawing attention to the particular location. When the light is flashing, and the switch is placed in the on position for a longer period of time and then turned off, the light will be turned off.

In a second embodiment, the circuit is placed in series with the lamp switch but is also contained in a small box that fits within the existing switch box. The operation of this embodiment is slightly different because of the series arrangement. In this embodiment, the lamp is caused to flash by moving the switch to the on position, moving it to the off position for a short period of time, and then returning it to the on position.

It is an object of this invention to provide an accessory for a switch box that is easily installed and that will permit a light to be controlled in a normal, on/off manner or in a second manner.

It is another object of the invention to provide an accessory that will cause a light controlled by a known two way switch to flash automatically.

It is yet another object of this invention to provide a unique circuit that will allow a light to be operated in a normal, on/off manner or in a flashing manner.

DETAILED DESCRIPTION OF THE PREFERRED EMBODIMENTS

Figure 1:
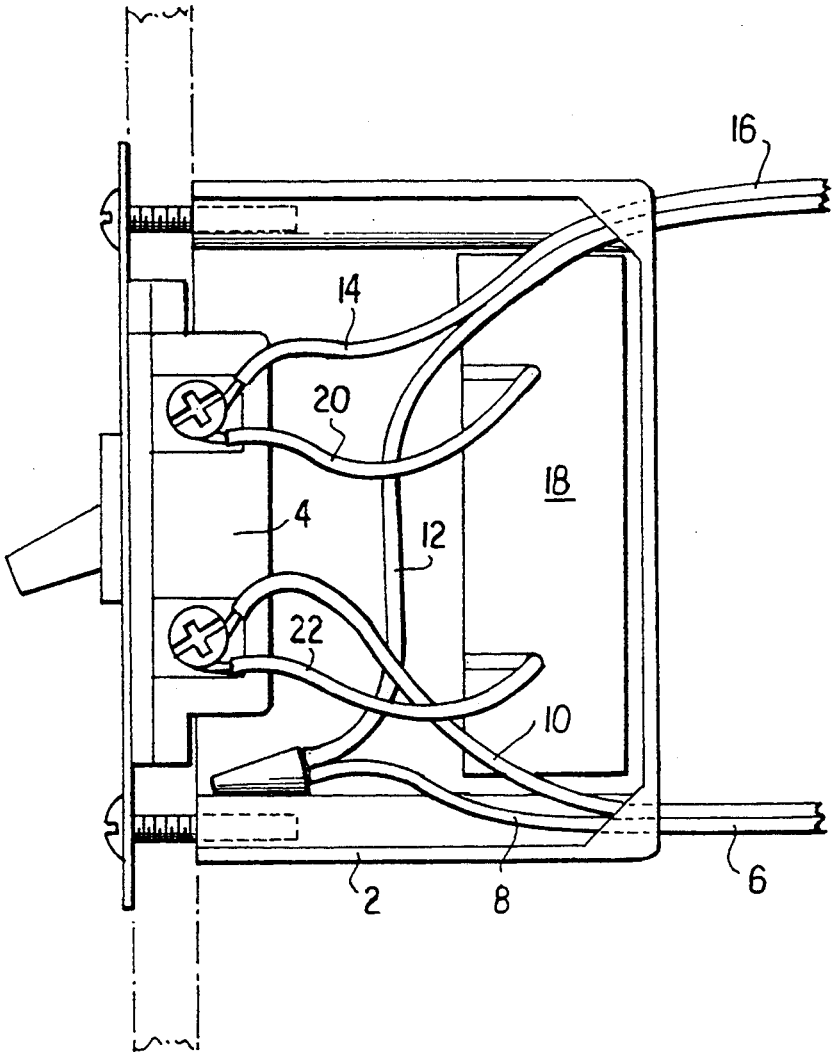
FIG. 1 is a vertical cross section of a known switch box showing an accessory in accordance with a first embodiment of the invention installed therein.

With reference to FIG. 1, a known switch box 2 is mounted on a wall or other surface in known manner. The switch box 2 encloses a known switch 4, which controls a light (not shown) connected to the switch. An electric cord 6 contains two lines, 8 and 10. Line 10 is connected to one terminal of switch 4, while line 8 is connected to line 12, which is directed to a light fixture (not shown). Line 12 is one of two lines in cord 16 that is connected to a light in known manner. The other line, 14, is connected to the other terminal of the switch 4. Typically, the lines 8, 10, 12, and 14 are installed by an electrician and are already in place when the device of the invention is installed. Of course, the device of the invention can be installed at the same time as lines 6 and 16 are installed.

Figure 2:
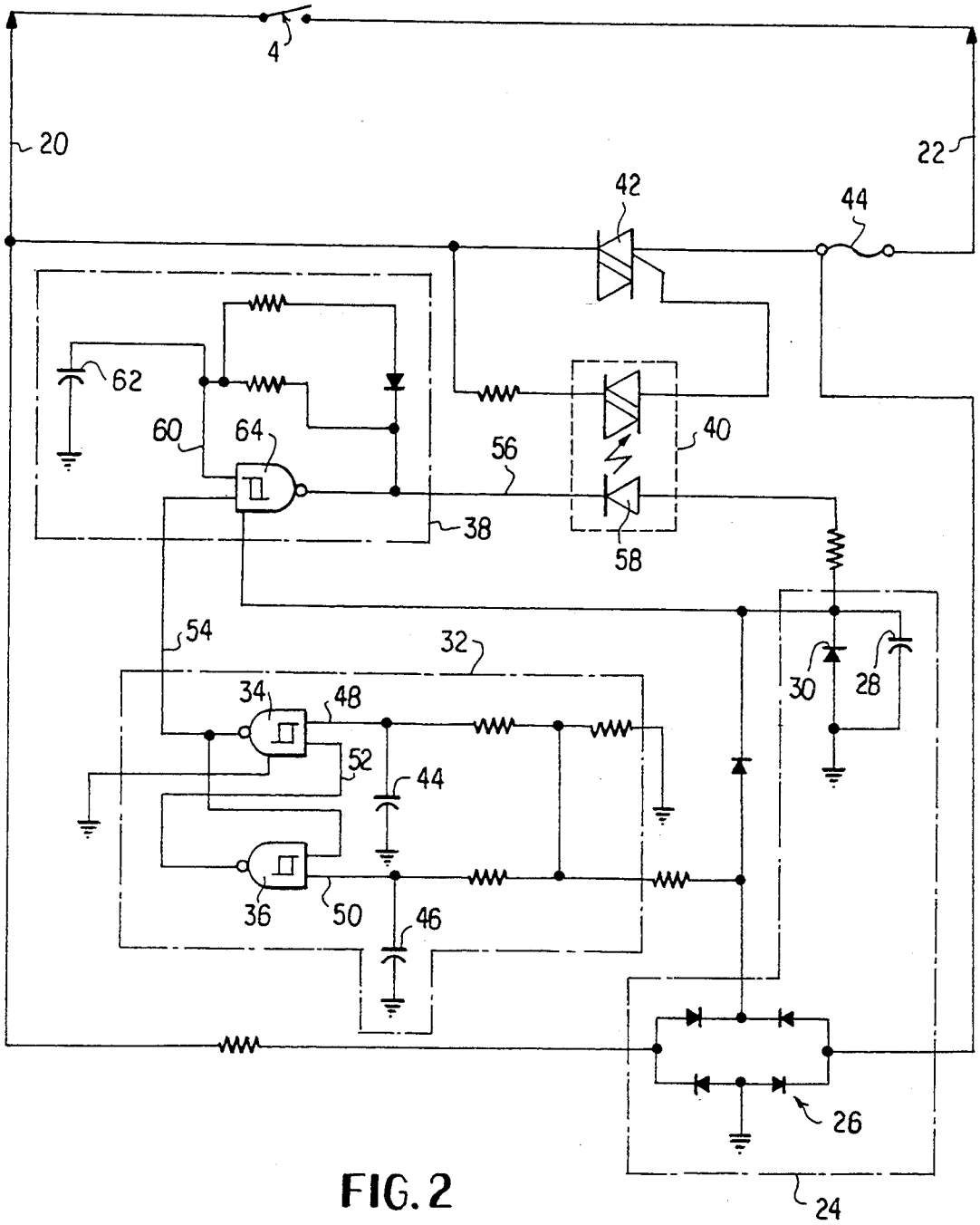
FIG. 2 is a circuit diagram of a first embodiment of a circuit in accordance with the invention.
Figure 3:
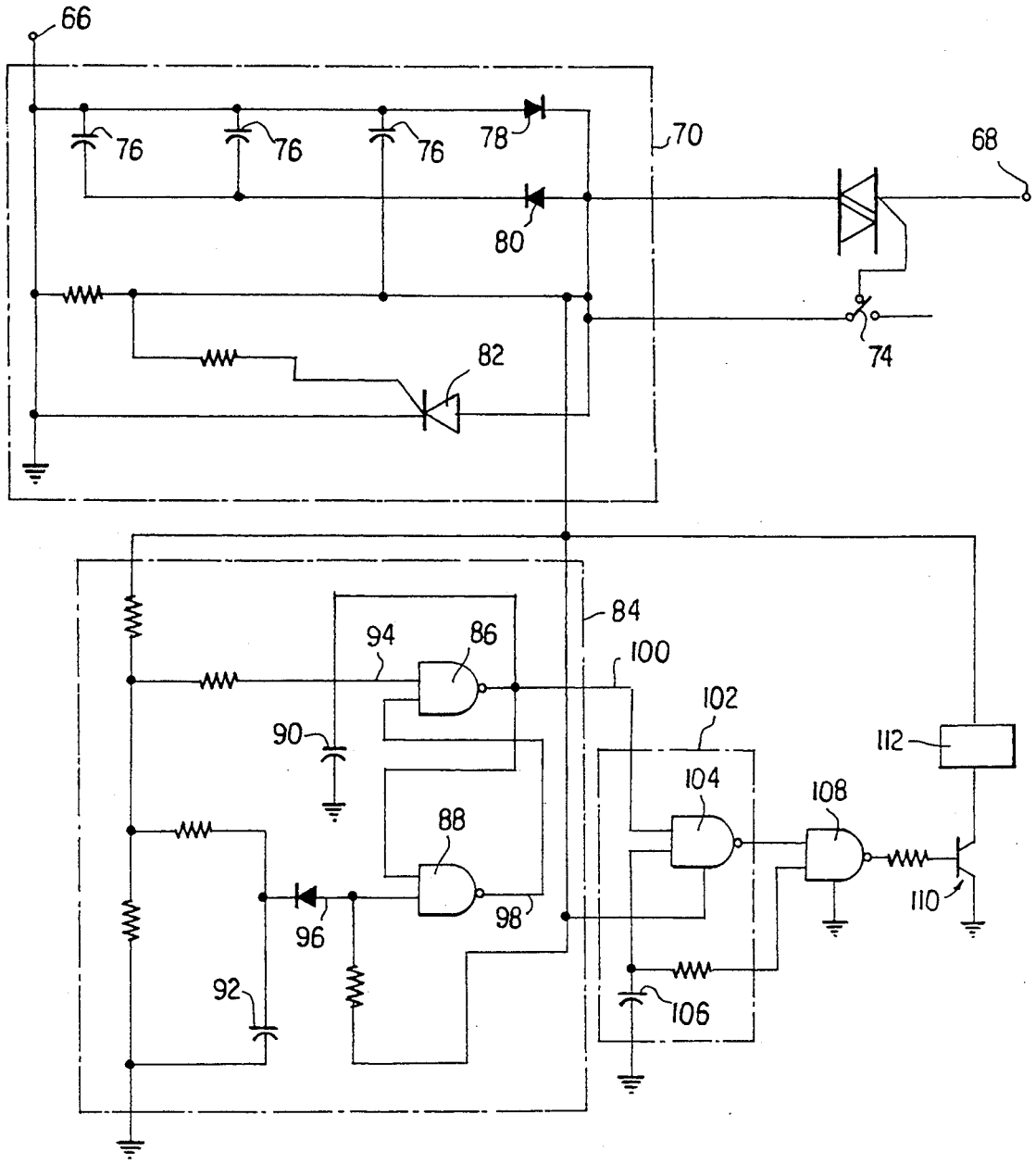
FIG. 3 is a circuit diagram of a second embodiment of a circuit in accordance with the invention.

The device of the invention, a first embodiment of which is shown in FIG. 1 as housing 18, is small enough to be placed inside the existing switch box 2 and behind the existing switch 4. The circuit of the invention, which will be described in detail with reference to FIGS. 2 and 3, is contained within the housing 18. The circuit in the housing is connected in parallel across the terminals of switch 4 by leads 20 and 22, as will be more clear with reference to FIG. 2.

FIG. 2 is a circuit diagram representing a first embodiment of a circuit in accordance with the invention. As noted, the circuit is connected across a known electric control switch 4 by leads 20 and 22. When switch 4 is open, or in the "off"position, the AC voltage of the power supply is applied across leads 20 and 22, which is, in turn, applied to power supply section 24 of the circuit. The power supply section consists of bridge circuit 26, capacitor 28, and diode 30. The bridge circuit 26 rectifies the AC line power, and the capacitor 28 charges to provide a 5V voltage, VCC. The value of capacitor 28 is chosen such that it continues to provide VCC during the interval when the circuit is shorted by conduction of triac 42, which will be described in more detail below, when the light is flashing. The current flow through the circuit when the switch 4 is open is very low, e.g., about 6 ma.

In addition to the power supply 24, the circuit includes a flip-flop 32 that includes two NAND gates 34 and 36. The output of the flip-flop 32 is connected to the input of a free running multi-vibrator 38. The output of the multi-vibrator 38 is connected to the input of an optocoupler 40 that controls the gate current of the triac 42. The triac 42 is placed in parallel with the switch 4 as will be described in more detail below.

When the switch 4 is closed, i.e. the lamp is turned "on," for a significant period of time, the switch shorts the circuit and prevents generation of the VCC voltage after capacitor 28 has discharged. In this condition, the circuit is inoperative, and the lamp is illuminated in the normal manner.

When switch 4 is opened, i.e , the lamp is turned "off," capacitor 44 will charge faster than does capacitor 46. Thus, lead 48 will go high while lead 50 is low. Because lead 50 is low, lead 52 will go high, forcing lead 54 to go low. With lead 54 low, the output lead 56 of the free running multivibrator 38 will always be high. Lead 56 is connected to the light illuminating diode 58 of the optocoupler 40. The light emitting diode 58 is reverse biased, whereby the high value on lead 56 does not activate the optocoupler 40.

When the switch is placed in the "on" position for a short period of time, however, and then switched to the "off" position, capacitors 44 and 46 begin to charge. The value of capacitor 46 and its associated resistors provide a large time constant such that capacitor 46 discharges slower than does capacitor 44. Thus, the value at lead 48 goes low before the value on lead 50 does. The low value on lead 48 forces the value on lead 54 to go high. The value on lead 52 is low, because the values on both inputs to NAND 36 are high.

The high value on lead 54 causes the output of the multivibrator 38 to oscillate in the following manner. Lead 56 first goes high because the input value on lead 60 is low. This high value causes capacitor 62 to increase. When the value on capacitor 62 is high, the output of NAND gate 64 goes low, thus producing current flow through LED 58 and triggering TRIAC 42. The charge on capacitor 62 then falls, thus forcing the value on lead 56 to go high again, and this process repeats at a rate set by the time constant determined by the values of capacitor 62 and its associated resistors.

It will be appreciated that the circuit shown in FIG. 2 is transparent when the switch 4 is operated normally. When switch 4 is placed in the on position for a short period of time, however, and then placed in the off position, the lamp will be caused to flash.

FIG. 3 illustrates a second embodiment of the invention. The principal advantage of this embodiment over that shown in FIG. 2 is that the circuit is in series with the lamp circuit. Thus, there is no current flow when the lamp switch is open.

With reference to FIG. 3, terminal 66 is connected to the lamp, and terminal 68 is connected to the lamp switch. When the lamp switch is open, no current flows through the circuit. When the lamp switch is closed, current flows through power supply 70 to create a VCC for the flashing control portion of the circuit. A triac 72 is placed in series with the lamp, and gate current is provided to the triac when the lamp switch is closed through a normally closed switch 74.

The power supply includes capacitors 76 and diodes 78 and 80. The diodes cause the positive going pulses of the line current to charge the capacitors. SCR 82 is placed in the circuit such that it will be placed in the conductive state when its gate voltage reaches a predetermined value, thus shunting the line current around the capacitors. By this arrangement, the capacitors 76 are charged to the desired VCC, and current at higher voltage is shunted around the capacitors.

Similar to the circuit shown in FIG. 2, the circuit in FIG. 3 includes a flip flop 84, which comprises two NAND gates, 86 and 88. The flip flop is provided with voltage from power supply 70.

When the lamp switch is off, the capacitors 76 do not charge, and the flip flop circuit is inoperative.

When the lap switch is turned on, the flip flop is provided with voltage, which causes it to attain a set condition. This is achieved by capacitors 90 and 92 at respective inputs to NAND gates 86 and 88. Capacitor 90 charges faster than does capacitor 92, which means that lead 94 goes high while lead 96 is low. Because lead 96 is low, the output of gate 88 on lead 98 will be forced high. The output of gate 86 on lead 100 is, therefore, low.

The output of the flip flop latch 84 is connected to the input of astable multivibrator 102, which is in its normal mode when the input is low. Thus, when the lamp switch is closed, the lamp is on, and the multivibrator is a fixed state.

When the lamp switch is closed and then opened for a short period of time, capacitor 90 will discharge faster than will capacitor 92. Thus, the value on lead 100 will be forced high, forcing the value on lead 98 low. This resets the flip flop and provides a high value on lead 100 even after power is restored by turning the lamp switch back on. A high value on lead 100 allows the output of NAND gate 104 to go high initially, when the voltage on capacitor 106 is low. After capacitor 106 charges, the output of gate 104 goes low, thus forcing the output of gate 108 high. The output of gate 108 is connected to the gate of transistor switch 110. Switch 110 is in series with an electromagnetic coil 112 that controls normally closed switch 74. Thus, when the output of gate 108 is high, transistor switch conducts and causes switch 74 to open. When switch 74 opens, triac 72 is in a non-conductive state, which turns the lamp off. When the charge of capacitor 106 bleeds off, the output of gate 108 will go low, thus closing transistor switch 112 and allowing switch 74 to close, causing the lamp to again be supplied with line current. By this action, the lamp is caused to flash at a rate determined by the time constant of the capacitor 106 and associated resistances.

It will be appreciated that the circuit shown in FIG. 3 is caused to flash by turning the lamp switch on, then off for a short time, and then back to the on position.

Modifications within the scope of the appended claims will be apparent to those of skill in the art.

I claim:

1. A method for causing an electric lamp to assume a flashing condition, wherein the operation of said lamp is controlled by an on/off switch that normally causes said lamp to be continuously illuminated when in an on position and not illuminated when in an off position, said method comprising providing said lamp with a flashing circuit and operating said switch to cause said lamp to flash by selecting the on position of said switch and the off position of said switch in a predetermined manner and leaving said switch in one of said on and off positions such that said lamp remains flashing until said switch is moved from said one position.

2. A method according to claim 1 wherein said predetermined manner comprises selecting said on position for a first period of time that is less than a predetermined period of time and then selecting the off position of said switch.

3. A method according to claim 2 wherein said method further comprises the step of terminating the flashing condition by selecting said on position of said switch for a period of time in excess of said predetermined period of time.

4. A method according to claim 3 wherein said step of terminating further comprises the step of selecting the off position of said switch.

5. A method according to claim 1 wherein said predetermined manner comprises selecting said on position, selecting said off position for a predetermined period of time, and then selecting said on position to place said lamp in a flashing condition.

6. A circuit for causing an electric lamp to flash comprising means for electrically connecting to a switch having an on position for allowing current to pass continuously to said lamp and an off position for not passing current to said lamp, a power supply for producing an operating voltage from a line voltage as a function of the on and off positions of said switch, latch means responsive to said operating voltage for producing a latch output voltage, and an oscillator circuit for receiving said latch output voltage and producing an oscillating voltage in response to a selected latch output voltage.

7. A circuit according to claim 6 wherein said circuit is designed to be placed in parallel with said switch.

8. A circuit according to claim 7 wherein said latch means is caused to produce said selected latch output voltage by closing said switch for a period of time less than a predetermined period of time and then opening said switch.

9. A circuit according to claim 6 wherein said circuit is designed to be placed in series with said switch that controls current to said lamp.

10. A circuit according to claim 9 wherein said latch means is caused to produce said selected latch output voltage by closing said switch, opening said switch for a period of time less than a predetermined period of time, and then closing said switch.

11. A circuit according to claim 6 wherein said latch means comprises two NAND gates.

12. Apparatus comprising a circuit according to claim 6 in combination with said switch.

13. Apparatus according to claim 12 in combination with a switch box, wherein said switch and said circuit are located in said switch box.

14. Apparatus for controlling a lamp comprising a switch having on and off positions for causing said lamp to be continuously illuminated when in said on position and not illuminated in said off position, and a flashing circuit means for causing said lamp to flash after said switch has been placed in said on and off positions in a predetermined manner and then left in one of said on and off positions while said lamp is flashing.

* * * * *